US009951927B2

(12) United States Patent
Yuan

(10) Patent No.: US 9,951,927 B2
(45) Date of Patent: Apr. 24, 2018

(54) LIGHTING DEVICE AND LUMINAIRE

(71) Applicant: PHILIPS LIGHTING HOLDING B.V., Eindhoven (NL)

(72) Inventor: Mou Kun Yuan, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/128,066

(22) PCT Filed: Jan. 29, 2015

(86) PCT No.: PCT/EP2015/051811

§ 371 (c)(1),
(2) Date: Sep. 21, 2016

(87) PCT Pub. No.: WO2015/144340

PCT Pub. Date: Oct. 1, 2015

(65) Prior Publication Data

US 2017/0102129 A1 Apr. 13, 2017

(30) Foreign Application Priority Data

Mar. 26, 2014 (WO) ..... PCT/CN2014/074115
May 20, 2014 (EP) ..... 14168921

(51) Int. Cl.
*F21V 7/20* (2006.01)
*F21V 13/12* (2006.01)
(Continued)

(52) U.S. Cl.
CPC ..... *F21V 13/12* (2013.01); *F21K 9/272* (2016.08); *F21K 9/90* (2013.01); *F21V 3/0481* (2013.01);
(Continued)

(58) Field of Classification Search
CPC ..... F21S 4/20; F21V 7/005; F21Y 2103/10
See application file for complete search history.

(56) References Cited

U.S. PATENT DOCUMENTS

2010/0253226 A1* 10/2010 Oki ..... F21V 3/00 315/113
2013/0033888 A1 2/2013 Van Der Wel et al.
(Continued)

FOREIGN PATENT DOCUMENTS

CN 202158387 U 3/2012
CN 102679226 A 9/2012
(Continued)

OTHER PUBLICATIONS

English translation of Zhu CN203068212U.*

*Primary Examiner* — Evan Dzierzynski

(57) ABSTRACT

There is provided a lighting device (100) comprising a first tubular body (120), a second tubular body (130) within the first tubular body (120), and a support structure within the first tubular body (120). The support structure supports a plurality of Solid State Lighting (SSL) elements (160) on a support surface, said SSL elements being arranged to emit light under a range of angles including a first range. The support structure is fixed within the first tubular body (120) by the first tubular body (120) and the second tubular body (130). The support structure comprises a tube receiving member (156) extending from the support surface, said tube receiving member engaging with the second tubular body (130).

13 Claims, 4 Drawing Sheets

(51) Int. Cl.

| | |
|---|---|
| ***F21K 9/272*** | (2016.01) |
| ***F21K 9/90*** | (2016.01) |
| ***F21V 19/00*** | (2006.01) |
| ***F21V 7/22*** | (2018.01) |
| ***F21V 3/04*** | (2018.01) |
| ***F21V 7/00*** | (2006.01) |
| ***F21V 15/01*** | (2006.01) |
| ***F21V 29/70*** | (2015.01) |
| ***F21V 29/503*** | (2015.01) |
| *F21Y 103/10* | (2016.01) |
| *F21Y 101/00* | (2016.01) |
| *F21Y 115/10* | (2016.01) |

(52) U.S. Cl.

CPC ..... *F21V 7/0025* (2013.01); *F21V 7/22* (2013.01); *F21V 15/01* (2013.01); *F21V 19/0035* (2013.01); *F21V 29/503* (2015.01); *F21V 29/70* (2015.01); *F21Y 2101/00* (2013.01); *F21Y 2103/10* (2016.08); *F21Y 2115/10* (2016.08)

(56) References Cited

U.S. PATENT DOCUMENTS

| | | | | |
|---|---|---|---|---|
| 2013/0064969 | A1 | 3/2013 | Inoue et al. | |
| 2013/0094200 | A1* | 4/2013 | Dellian ..... | F21V 3/00 362/218 |
| 2013/0113393 | A1 | 5/2013 | Fujita et al. | |
| 2015/0146407 | A1* | 5/2015 | Boonekamp ..... | F21V 3/02 362/84 |

FOREIGN PATENT DOCUMENTS

| | | | |
|---|---|---|---|
| CN | 203068212 | U | 7/2013 |
| JP | 2002197901 | A | 7/2002 |
| KR | 20130107114 | A | 10/2013 |
| WO | 2011099288 | A1 | 8/2011 |
| WO | 2013064969 | A1 | 5/2013 |
| WO | 2013179227 | A2 | 12/2013 |

* cited by examiner

LIGHTING DEVICE AND LUMINAIRE

CROSS-REFERENCE TO PRIOR APPLICATIONS

This application is the U.S. National Phase application under 35 § 371 of International Application No. PCT/EP2015/051811, filed on Jan. 29, 2015, which claims the benefit of Chinese Patent Application No. PCT/CN2014/074115, filed on Mar. 26, 2014 and European Patent Application No. 14168921.6, filed on May 20, 2014. These applications are hereby incorporated by reference herein.

FIELD OF THE INVENTION

The present invention relates to a lighting device, in particular to a lighting device comprising Solid State Lighting (SSL) elements.

The present invention also relates to a method of assembling the lighting device and to a luminaire comprising the lighting device.

BACKGROUND OF THE INVENTION

With a continuously growing population, it is becoming increasingly difficult to meet the world's energy needs and, simultaneously, to control carbon emissions to kerb greenhouse gas emissions which are considered responsible for global warming phenomena. These concerns have triggered a drive towards a more efficient use of electricity in an attempt to reduce energy consumption.

One such area of concern is lighting applications, either in domestic or commercial settings. There is a clear trend towards the replacement of traditional, relatively energy-inefficient, light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, e.g. when replacing incandescent light bulbs.

A particularly promising alternative is provided by solid state lighting (SSL) devices, which can produce a unit luminous output at a fraction of the energy cost of incandescent or fluorescent light bulbs. An example of such a SSL element is a light emitting diode (LED).

It is known to provide SSL lighting devices having a similar overall shape to fluorescent light tubes, i.e. tubular solid state lighting devices. These tubular SSL devices may be used to replace fluorescent light tubes or used in similar applications to fluorescent light tubes.

An example of a prior art tubular SSL element-based lighting device comprises a tubular body, within the tubular body is a printed circuit board onto which a plurality of LED elements are mounted at regular intervals.

In one known construction, the printed circuit board is taped to the tubular body using a double sided tape. However, the fixing of components in place using tapes can be awkward. Specifically, as such tape is necessarily sticky it can be difficult to position within the tubular body, particularly if the tube is of some length. For example, if the tape is first fixed to the tubular body, the tape may become stuck prematurely in a non-desired position or, if the tape is first fixed to the printed circuit board, the printed circuit board may become stuck in a non-desired location. Additionally, the use of tapes can be difficult to automate.

SUMMARY OF THE INVENTION

The present invention seeks to provide a lighting device that can be assembled in a straightforward manner.

The invention provides a lighting device comprising a first tubular body; a second tubular body within the first tubular body; and a support structure within the first tubular body supporting a plurality of SSL elements on a support surface, said SSL elements being arranged to emit light under a range of angles including a first range, wherein the support structure is fixed within the first tubular body by the first tubular body and the second tubular body.

As the support structure is fixed, i.e. held in place, within the first tubular body by the first tubular body and the second tubular body, the device may be assembled without the need for complex components or components which are difficult to assemble, including tapes. Further, this lighting device may be assembled using relatively simple procedures. Because of these factors the lighting device may be provided in a relatively cost-effective manner.

In some application domains, certain angles under which the SSL elements emit light may have to be shielded from direct observation by an external observer, e.g. to prevent or reduce glare. In other words, as the SSL elements emit light under a range of angles including a first range, the first range of angles may have to be excluded from direct observation. To this end, in some embodiments the lighting device may comprise a first tubular body provided with a diffusive and/or reflective region facing the luminous surfaces of the SSL elements, said diffusive and/or reflective region being dimensioned to diffuse and/or reflect the light emitted by said SSL elements under emission angles within said first range.

A diffusive region may obscure the SSL elements, at least from certain viewing angles, such that the SSL elements are not perceived as separate luminous point sources, but instead the lighting device presents a uniform appearance in use.

A reflective region may obscure the SSL elements, at least from certain viewing angles, as light from the SSL elements within said first range cannot directly exit the lighting device. The diffusive and/or reflective region may be provided by a film or a coating.

If the diffusive and/or reflective region is provided by a film the film may be inserted into the first tubular body using the second tubular body and then held in place. For example, the film may be held in place by its natural tendency to uncurl, which is a particularly simple way of holding (or fixing) the film in place.

At least one of the first tubular body and the second tubular body may be of glass. Use of glass tubular bodies may be particularly economic. Further, as glass bodies are relatively rigid it may be possible to provide lighting devices of some length without the need for additional structural elements.

The support structure may comprise a carrier selected from at least one of a printed circuit board and a heat sink, wherein the SSL elements are mounted on said carrier.

The support structure may comprise a container including said support surface, said container further comprising a light exit window opposite the support surface and separated from said support surface by a plurality of side surfaces, said light exit window being dimensioned to allow light emitted by the SSL elements under said first range of emission angles to directly exit the container; and the support structure comprises a diffusive and/or reflective structure extending from the support surface to the light exit window for preventing light emitted by the SSL elements under emission angles outside said first range from directly exiting the container.

The light exit window may be a transparent or translucent side of the container. Accordingly, the container may enclose the SSL elements such that if the first tubular body is broken the SSL elements and other electrical components of the lighting device may not be exposed.

Alternatively, the light exit window may be an opening.

The SSL elements may be directly mounted on the support surface. Alternatively, the SSL elements may be mounted on a carrier supported by the support surface.

The side surfaces may include said diffusive and/or reflective structure.

The diffusive and/or reflective structure may comprise at least one sloped section for redirecting light emitted by the plurality of SSL elements under an angle outside said first range towards the light exit window.

This may increase the amount of light exiting through the light exit window and therefore increase the luminous efficiency of the device.

The lighting device may comprise at least two of said sloped sections, wherein each of the two sloped sections is provided by a discrete component.

The support structure may comprise at least one tube receiving member extending from the support surface, said at least one tube receiving member engaging with the second tubular body.

The second tubular body may be transparent or translucent.

The lighting device may further comprise at least one cap comprising a first engagement feature in engagement with the first tubular body; a second engagement feature in engagement with the second tubular body; and a third engagement feature in engagement with the support structure.

Such a cap can hold the first tubular body, the second tubular body and the support structure in position. In this way, alignment of the components of the lighting device may be achieved in a simple manner. Further the cap may provide electrical connections between the SSL elements and a power supply, optionally via a driver optionally included in the cap.

The invention also provides a luminaire comprising the lighting device as described above. Because, as described above, the lighting device may be provided in a relatively cost-effective way, the luminaire comprising the lighting device may also be provided in a relatively cost-effective way.

The invention further provides a method of assembling a lighting device as described above comprising inserting the second tubular body into the first tubular body; inserting the support structure into the first tubular body; and fixing the support structure within the first tubular body using the first tubular body and the second tubular body.

As this method is relatively simple and does not require steps involving complex or awkward components, such as tapes, the method may be easier to carry out and/or more easily automated. Consequently, the method may be used to assemble lighting devices in a cost-effective manner.

When the first tubular body is provided with a diffusive and/or reflective region facing the SSL elements provided by a film, the method may further comprise inserting the film into the first tubular body with the second tubular body and affixing the film to the first tubular body.

As insertion of the film into the first tubular body is performed with the insertion of the second tubular body into the first tubular body, the number of steps necessary for assembling a lighting device comprising a diffusive and/or reflective film facing the SSL elements is reduced. Accordingly, this method may be used to assemble such lighting devices in a cost-effective way.

BRIEF DESCRIPTION OF THE DRAWINGS

Embodiments of the invention are described in more detail and by way of non-limiting example with reference to the accompanying drawings, wherein.

DETAILED DESCRIPTION OF THE EMBODIMENTS

Figure 1:
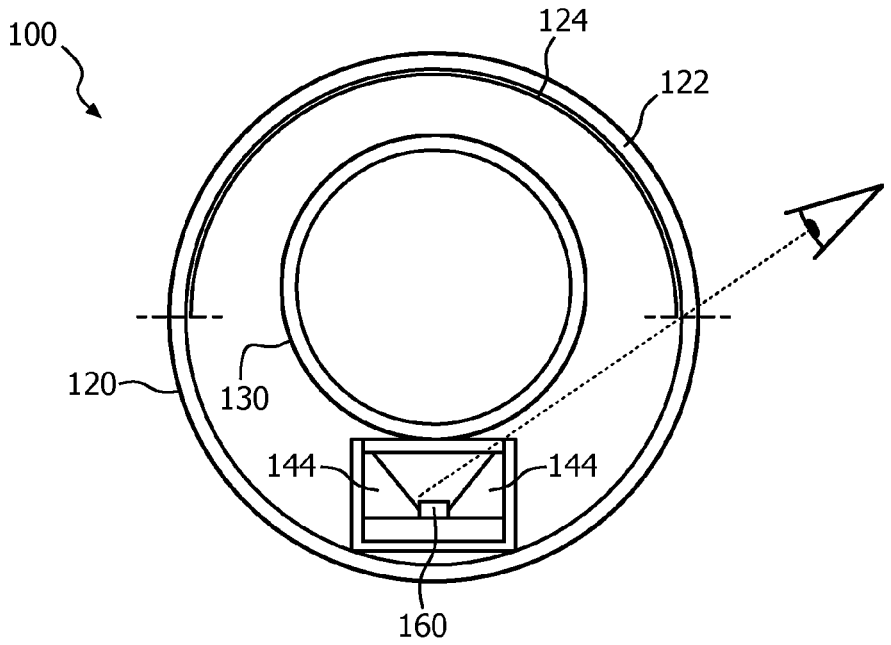
FIG. 1 depicts a schematic cross-section of a lighting device according to an embodiment of the present invention.

It should be understood that the Figures are merely schematic and are not drawn to scale. It should also be understood that the same reference numerals are used throughout the Figures to indicate the same or similar parts.

Referring firstly to FIG. 1 of the accompanying drawings, a lighting device, indicated generally at 100, comprises a first tubular body 120 and a second tubular body 130 within the first tubular body 120. The lighting device 100 also comprises a support structure within the first tubular body 120. The support structure supports a plurality of Solid State Lighting (SSL) elements 160 on a support surface. The SSL elements 160 are arranged to emit light under a range of angles including a first range.

In some application domains, certain angles under which the SSL elements 160 emit light may have to be shielded from direct observation by an external observer, e.g. to prevent or reduce glare. In other words, as the SSL elements 160 emit light under a range of angles including a first range, the first range of angles may have to be excluded from direct observation. To this end, in some embodiments the lighting device 100 may comprise diffusive and/or reflective structures, as described below.

The support structure is fixed within the first tubular body 120 by the first tubular body 120 and the second tubular body 130. The support structure may be or comprise any structure which is capable of supporting the plurality of SSL elements as may be known to the person skilled in the art. By way of non-limiting example, the support structure may comprise a carrier selected from at least one of a printed circuit board 154, a heat sink 152 and a container 146.

In the context of the present specification, that the support structure is fixed (or secured) within the first tubular body 120 by the first tubular body 120 and the second tubular body 130 it is meant that the support structure is kept in place by cooperation between the first tubular body 120 and the second tubular body 130. In other words, the support structure is immobilised between the first tubular body 120 and the second tubular body 130 or the support structure is held in place by cooperation between the first tubular body 120 and the second tubular body 130 with the support structure.

As the support structure is fixed within the first tubular body 120 by the first tubular body 120 and the second tubular body 130, the solid state lighting elements 160 may be fixed within the first tubular body 120 without the need for complex components or components which are difficult to assemble.

As described below, this lighting device 100 may be assembled using relatively simple procedures. In turn, this allows embodiments of the lighting device 100 to be assembled on an automated line.

Further, this structure may provide an optical efficiency and light distribution equivalent to prior art plastic tubular solid state lighting devices.

The tubular bodies 120, 130 may have any suitable sizes, provided the second tubular body 130 may be inserted into the first tubular body 120.

At least one of the first tubular body 120 and the second tubular body 130 may be of glass.

Use of glass tubular bodies 120, 130 may be particularly economic. In particular, glass tubular bodies may be obtained at a lower cost than plastic tubular bodies. In some cases glass tubular bodies may cost as little as one tenth of the price of comparable plastic tubular bodies.

Further, the particular combination of using glass tubular bodies and fixing the support structure within the first tubular body 120 by the first tubular body 120 and the second tubular body 130 may be used to particular advantage, in that complex lighting device structures previously required when using glass tubular bodies are not necessary (e.g. complex components or components which are difficult to assemble, e.g. tapes). Accordingly, as glass is relatively cheap and simple assembly procedures are generally cheaper, this combination may be used in a particularly cost-effective way.

Another benefit is that glass has better heat dissipation capability than many plastics materials. Therefore, a glass tubular body may form at least a part of a heat sink used to regulate the temperature of the SSL elements 160 in use. Accordingly, use of a glass tubular body may mean that it is not necessary to provide a separate heat sink. Alternatively, where a separate heat sink is provided, the heat sink may be smaller, as glass tubular bodies can better participate in heat dissipation than many plastics tubular bodies. Omission of a discrete heat sink can make assembly of the lighting device simpler and more economic, and use of a smaller heat sink may be more economic.

The bottom surface of the support structure (e.g. the bottom surface of the container 146 or a heat sink) may be a curved surface, this can provide a good contact between the support structure and the inner surface of the first tubular body 120. In turn, this good contact between the support structure and the first tubular body 120 can provide good heat conductivity between the support structure and the first tubular body 120 and hence good heat dissipation.

Additionally, use of plastic tubular bodies beyond a certain length may require the use of additional structural elements to prevent the plastic tubular bodies from bending or sagging. However, as glass materials are generally less flexible than plastics materials, additional structural elements to prevent sagging may not be required for lighting devices longer than the above mentioned certain length. Further, fixing the support structure by the first tubular body 120 and the second tubular body 130 also does not necessarily require substantial structural elements. For example, in some embodiments, further immobilization structures such as an adhesive tape may be omitted altogether or the amount of such immobilization structures may be significantly reduced, e.g. tape portions may be used at the end portions of the first tubular body 120 only to further immobilize the support structure. Accordingly, the combination of fixing the support structure by the first tubular body 120 and the second tubular body 130 and the use of a glass tubular body may be used to particular advantage, in that this structure and material combination is particularly simple and additional structural elements may not be required, even for lighting devices longer than the above mentioned certain length. Therefore, this combination may be particularly economic or cost-effective.

As SSL elements, such as LEDs, act as point light sources, this can give rise to SSL element-based lighting devices having a spotted luminous appearance. This spotted luminous appearance may be undesirable. In particular, it is noticeably different to the appearance of fluorescent light tubes, which typically produce a substantially homogeneous or uniform luminous output and such differences in appearance may hinder uptake of SSL lighting devices. Further, directly visible SSL elements may result in glare (difficulty seeing in the presence of bright light). Lighting with glare issues as a result of high luminance (luminous intensity per unit area) may be less preferred for certain tasks, for example, office work, home lighting, workshop lighting, etc.

The first tubular body 120 may be provided with a diffusive and/or reflective region 122 facing the luminous surfaces of the SSL elements 160, said diffusive and/or reflective region 122 being dimensioned to diffuse and/or reflect the light emitted by said SSL elements 160 under emission angles within said first range.

The diffusive and/or reflective region 122 obscures the SSL elements in normal use within said first range. For example, if the region 122 is diffusive the light generated by the SSL elements 160 under emission angles within said first range may be diffused such that the SSL elements 160 are not perceived as separate luminous point sources, but instead the lighting device 100 provides a more uniform appearance in use. If the appearance is more uniform glare issues may be significantly reduced.

Alternatively, if the region 122 is reflective then as light emitted under the first range is reflected instead of exiting the lighting device 100, this can also help to reduce glare, at least from certain viewing angles.

If the region 122 is reflective and diffusive (sometimes called diffuse reflective) then the light generated by the SSL elements 160 under emission angles within said first range may be reflected and diffused such that the SSL elements 160 are not perceived as separate luminous point sources and, further, the light from the SSL elements 160 is provided over a wider area. This may improve the appearance of the lighting device and, further, reduce glare as explained above.

The first range may be chosen in order to maximise the effect of providing light over a wide area. In a non-limiting example embodiments, said first range may be 180° or less. In other non-limiting example embodiments, said first range may be from 30° to 150°, from 50° to 130°, from 70° to 110°, from 80° to 100°, or about 90°. Of course, the first range may be any other suitable range as chosen by a skilled person.

The diffusive and/or reflective region 122 may be provided by a film 124. If the first tubular body 120 is of glass, then as the diffusive and/or reflective region 122 may not easily be provided by blending, etching or co-extrusion, use of such a film 124 may be a particularly convenient way of providing the diffusive and/or reflective region 122. For example, the film 124 may be inserted into the first tubular body 120 with the second tubular body 130, as described below.

Such a film 124 may be held in place against the first tubular body 120 by its natural tendency to uncurl. This is a particularly simple way of holding (or fixing) the film 124 in place.

In the embodiments illustrated in FIGS. 1 to 5, the film 124 is internal to the first tubular body 120. However, the film may be on an external surface of the tubular body 120. As will be apparent, a film on an external surface of the first tubular body 120 does not need to be inserted within the first tubular body 120 and accordingly may be easy to assemble. However, such a film will need to be affixed to the first tubular body 120, for example, with an adhesive. However, such a film may be more easily damaged and, further, perceived as less aesthetically pleasing as it does not present a smooth surface at the film edges.

The use of a film 124 may be advantageous in that a film 124 may provide a uniform thickness along the length of the lighting device 100, even if the lighting device 100 is of some length. Whereas, providing a coating, particularly on an internal surface of a tubular body, of uniform thickness of some length may be challenging. This is because accessing the internal surfaces of the tubular body, in order to apply the coating, particularly in the centre of the tubular body, is hindered by the end portions of the tubular body.

Alternatively, the diffusive and/or reflective region 122 may be provided by a coating. The coating may be applied to the internal or the external surface of the first tubular body 120. For example, the coating may be painted onto an external surface of the first tubular body 120. Alternatively, the coating may be applied to an internal surface of the first tubular body 120 using the process known as liquid coating. In the liquid coating process, a liquid is prepared which comprises diffusive particles, such as a phosphor, the liquid is then flowed through the tubular body and the tube is dried under a flow of hot air. The liquid on the internal surface of the tubular body is thus dried forming a coating which is adhered to the internal surface. The support structure may comprise a carrier wherein the SSL elements 160 are mounted on the carrier.

The carrier may comprise a printed circuit board 154, in which case, the SSL elements 160 may be mounted on the printed circuit board 154 and the support surface of the support structure may be provided by the printed circuit board 154.

A printed circuit board is a convenient way of supplying electricity to the solid state lighting elements 160. The printed circuit board 154 may be of materials commonly used in the art and manufactured according to such procedures as are known to the skilled person.

The carrier may comprise a heat sink 152, a heat sink can help regulate the temperature of the SSL elements 160 in use, potentially increasing the lifespan and/or reliability of the SSL elements. Accordingly, as is known in the art, a heat sink 152 may be particularly advantageous where the lighting device provides a high luminous output.

The heat sink may be of any suitable thermally conductive material as is known in the art, for example a metal such as aluminium.

Each SSL element 160 may be mounted on a separate support structure or at least some SSL elements 160 may share a supporting structure. For example, the SSL elements 160 may be mounted on a single supporting structure.

The support structure may comprise a container 146 including the support surface. The container 146 may comprise a light exit window 148 opposite the support surface and separated from said support surface by a plurality of side surfaces 150, said light exit window being dimensioned to allow light emitted by the SSL elements under said first range of emission angles to directly exit the container 146. The support structure may comprise a diffusive and/or reflective structure extending from the support surface to the light exit window for preventing light emitted by the SSL elements under emission angles outside said first range from directly exiting the container.

The light exit window 148 may be a transparent or translucent side of the container 146, alternatively, the light exit window 148 may be an opening.

If the light exit window 148 is a transparent or translucent side of the container 146, then the container 146 may enclose the SSL elements 160. Therefore, if the first tubular body 120 is broken, e.g. shattered, the SSL elements and other electrical components of the lighting device may not be exposed. This may help mitigate the risk that consumers will be exposed to the SSL elements 160 and/or other live electrical components. In other words, use of a container 146 which does not have an opening can provide a safer device.

The container 146 may be of any suitable material. However, shatter resistant materials may be preferred, since this can also help mitigate the risk that consumers will be exposed to electrical components, as described above.

In a preferred arrangement the container 146 is of polycarbonate. For example, the side surfaces 150, and the base 151 of the container 146 may be of white opaque polycarbonate and the light exit window 148 may be of transparent polycarbonate. The container 146 may be made of any other suitable materials known to the skilled person, e.g. PET or PMMA, and may be manufactured according to procedures known to the skilled person.

In an alternative arrangement, the light exit window 148 may be of a translucent material. If the light exit window is sufficiently diffusive, it may not be necessary to provide further diffusers and/or reflectors in order to provide a sufficiently homogeneous light output, i.e. a light output in which the SSL elements 160 are not individually visible.

The combination of a diffusive region 122 which is dimensioned to diffuse the light emitted by the SSL elements under emission angles within the first range and a light exit window 148 dimensioned to only allow light emitted by the SSL elements 160 under the first range of emission angles to directly exit the container 146, means that the SSL elements 160 are not directly visible in normal use of the lighting device 100. This is illustrated by the line of sight drawn in FIG. 1. In other words, light generated by the SSL elements 160 may not directly exit the lighting device 100. Accordingly, light generated by the SSL elements 160 must contact the diffusive region 122, the side surfaces 150 and/or the sloped sections 142 in order to exit the lighting device 100. Therefore, if the region 122, side surfaces 150 and/or sloped sections 142 are sufficiently diffusive the SSL elements 160 will not be directly visible and the SSL elements 160 may not be perceived as separate luminous point sources, therefore the lighting device 100 may provide a uniform appearance and less glare in use. In other words, the lighting device 100 may provide a light output having an appearance that is comparable with traditional lighting devices, such as incandescent and fluorescent light bulbs.

The diffusive and/or reflective structure of the support structure may comprise at least one sloped section 142 for redirecting light emitted by the plurality of SSL elements 160 under an angle outside said first range towards the light exit window 148.

This may increase the amount of light exiting through the light exit window 148 and hence increase the efficiency of the device.

Figure 2:
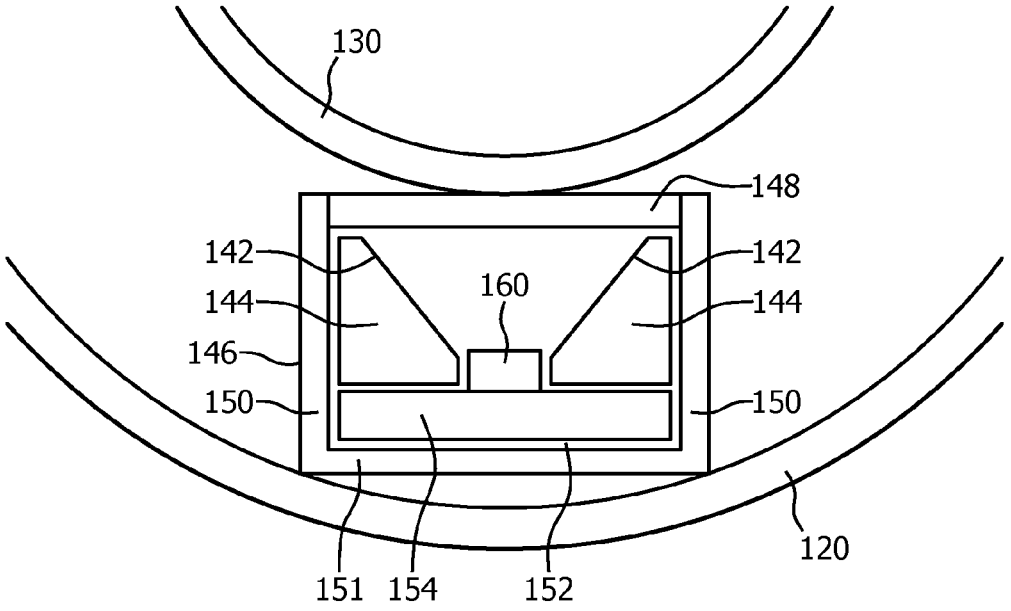
FIG. 2 depicts an enlarged part of the schematic cross-section of FIG. 1.

The lighting device 100 may comprise at least two of sloped sections 142, as shown in FIGS. 1 and 2.

Further each of the two sloped sections may be provided by a discrete component 144. In some embodiments, e.g. as illustrated in FIGS. 1 and 2, the sloped sections 142 may be provided by substantially triangular discrete components 144.

Use of discrete components 144 may help to avoid shrinkage deformation. In particular, providing a single component which is both shatter-resistant and thermally-resistant can be a challenge. The use of discrete components 144 to provide the sloped sections 142, means that is not necessary to provide a component which is both shatter-resistant and sufficiently thermally-resistant to be placed adjacent the SSL elements 160. Further, the discrete components 144 can be used to fix the PCB 154 in place, such that the PCB 154 cannot touch the light exit window 148 and is immobile within the container.

An alternative way of providing the sloped sections 142 comprises use of a V-shaped reflector. The reflector may be made of any suitable reflective material, for example a metal such as aluminium or a plastic. The reflector may comprise a reflective coating, for example the material from which the reflector is made may not be intrinsically reflective and may instead comprise a reflective coating. The material from which the reflector is made preferably has a certain stiffness, such that the reflector maintains its shape over a period of time.

The second tubular body 130 may be transparent or translucent. If the second tubular body 130 is transparent then for the lighting device 100 to provide a homogeneous luminous output other elements of the lighting device 100 may be responsible for homogenising the luminous output of the SSL elements 160, such as the region 122 and the container 146, described above. However, if the second tubular body 130 is translucent and if the second tubular body 130 is dimensioned to diffuse and/or reflect the light emitted by said SSL elements under emission angles within said first range and the support structure comprises a diffusive and/or reflective structure for preventing light emitted by the SSL elements under emission angles outside said first range from directly exiting the container, then this alone may be sufficient for the lighting device 100 to provide a homogeneous luminous output.

The second tubular body 130 may be made translucent in a similar manner to that discussed above in respect of the diffusive and/or reflective region 122. For example, the second tubular body 130 may be of plastics and be etched or may comprise a translucent plastics material. Alternatively, the second tubular body 130 may be of glass and comprise a diffusive film or coating on the inner or outer surface of the second tubular body 130. For example, the film may be inserted into the second tubular body 130 using a similar technique to that used to insert the film 124 into the first tubular body 130, as described below. Of course, an alternative means must be used to insert the film into the second tubular body 130, e.g. a further tubular body with a smaller diameter than the second tubular body 130.

Figure 3:
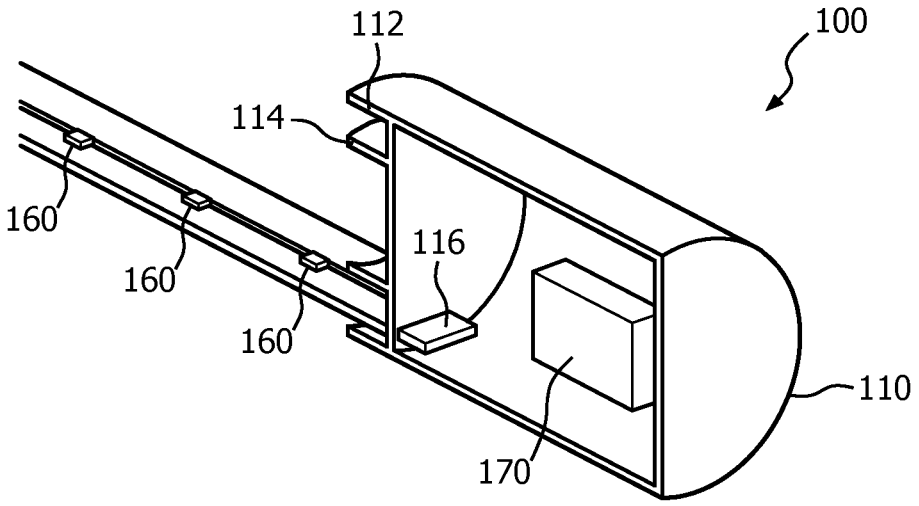
FIG. 3 depicts a schematic perspective view of the partially assembled lighting device of FIG. 1 in partial cross-section.
Figure 4:
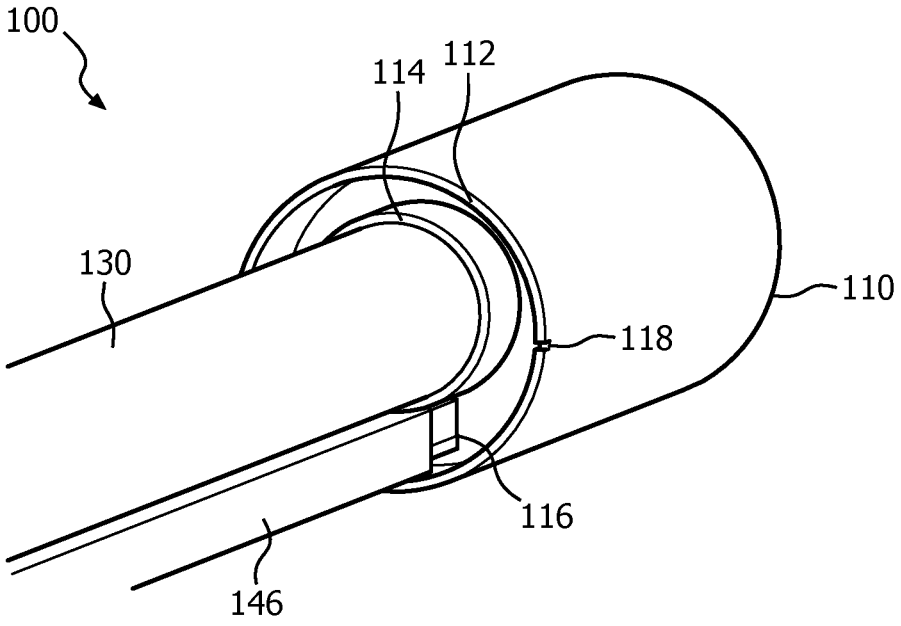
FIG. 4 depicts an additional schematic perspective view of the partially assembled lighting device of FIG. 1.
Figure 5:
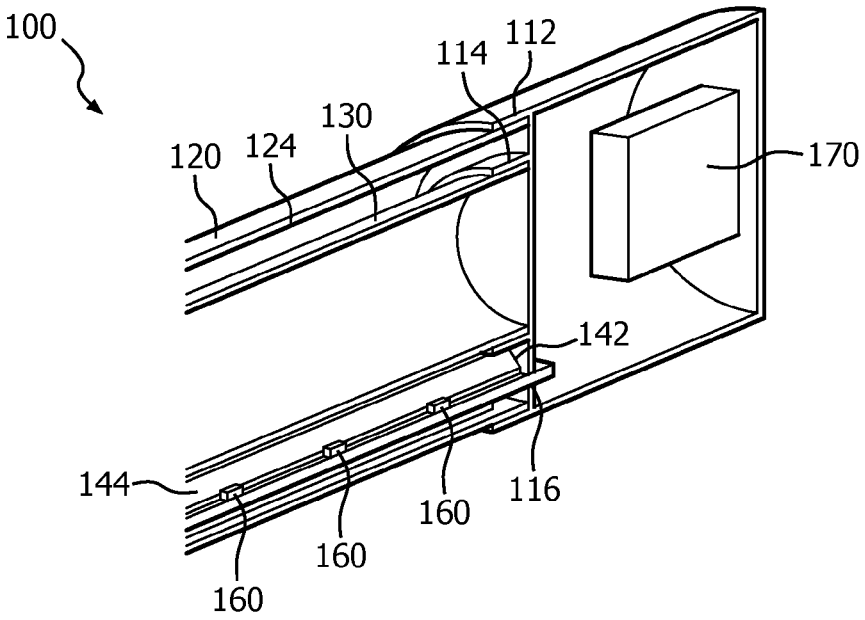
FIG. 5 depicts a schematic perspective view of the lighting device of FIG. 1 in partial cross-section.

As illustrated in FIGS. 3, 4 and 5, the lighting device 100 may further comprise at least one cap 110. The cap 110 may comprise a first engagement feature 112 in engagement with the first tubular body 120; a second engagement feature 114 in engagement with the second tubular body 130; and a third engagement feature 116 in engagement with the support structure.

The cap 110 can hold the first tubular body 120, the second tubular body 130 and the support structure in position. However, other arrangements for holding the first tubular body 120, the second tubular body 130 and the support structure imposition may be realised, for example any fixing element may be used for this purpose, e.g. a discrete fixing element, a component of a luminaire in which they lighting device 100 is situated, and other alternatives which may occur to the skilled person in light of the present disclosure.

The cap 110 may hold a driver 170. The driver 170 may comprise driver circuitry for driving the SSL elements 160. Such an arrangement facilitates integration of the necessary driver circuitry into the lighting device 100. If the lighting device 100 comprises integrated driver circuitry it may be easier to retrofit the lighting device 100 into traditional luminaires.

Further the cap 110 may provide electrical connections between the SSL elements 160 and a power supply. For example, the cap 110 may comprise connectors, such as pins, which connect to an electrical supply, e.g. an electrical supply of a fitting, such as a fitting of a luminaire.

Figure 6:
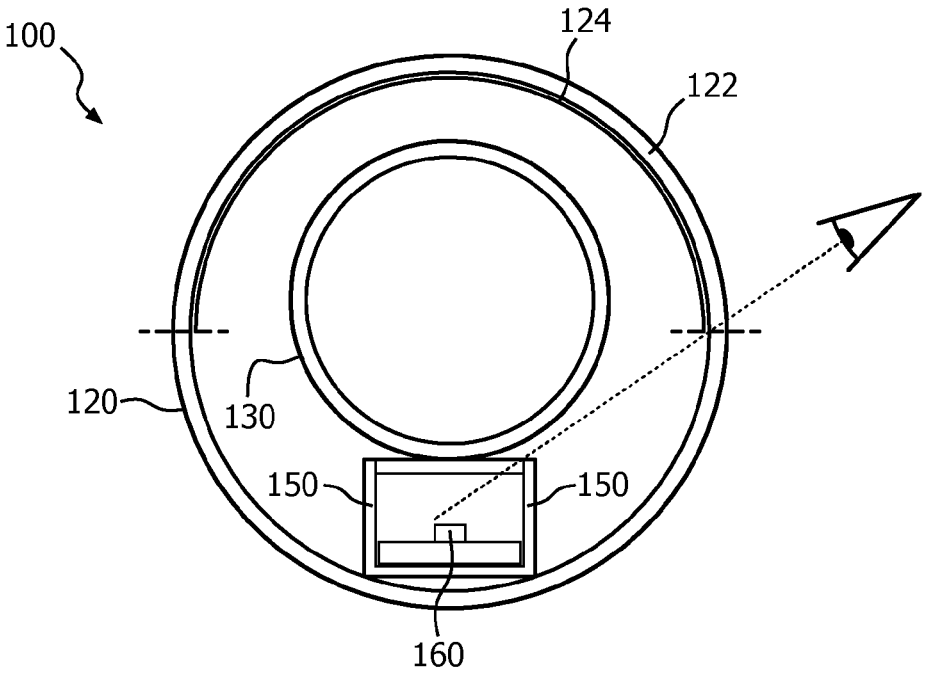
FIG. 6 depicts a schematic cross-section of a lighting device according to another embodiment of the present invention.

FIG. 6 illustrates further features of embodiments of a lighting device 100. These embodiments are substantially similar to the embodiments described above, accordingly, only the key differences will be described.

In FIG. 6 the diffusive and/or reflective structure of the support structure does not comprise a sloped section 142 for redirecting light emitted by the plurality of SSL elements 160 under an angle outside said first range towards the light exit window. Instead, the said side surfaces 150 of the container 146 include the diffusive and/or reflective structure of the support structure. However, as described above, the combination of the diffusive and/or reflective region 122 which is dimensioned to diffuse and/or reflect the light emitted by the SSL elements under emission angles within the first range and the light exit window 146 dimensioned to only allow light emitted by the SSL elements under the first range of emission angles to directly exit the container, means that the SSL elements 160 are not directly visible in normal use of the lighting device 100. This is illustrated by the line of sight drawn in FIG. 6.

Figure 7:
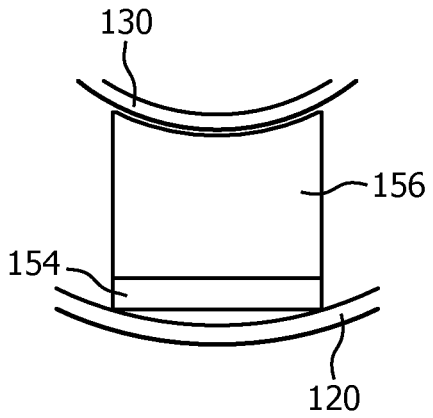
FIG. 7 depicts a schematic cross-section of part of a lighting device according to a further embodiment of the present invention.
Figure 8:
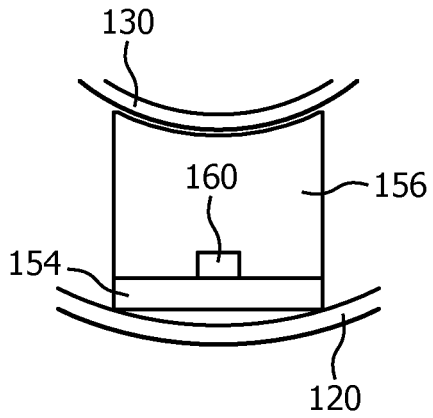
FIG. 8 depicts a further schematic cross-section of a part of the lighting device of FIG. 7.

FIGS. 7 and 8 illustrate further features of embodiments of a lighting device 100. These embodiments are substantially similar to the embodiments described above, accordingly, only the key differences will be described.

In the lighting device of FIGS. 7 and 8, the carrier comprises at least one tube receiving member 156 extending from the support surface. The at least one tube receiving member 156 engages with the second tubular body 130.

In particular, in the embodiments described above the support structure comprises a container, however, in the non-limiting example embodiments of FIGS. 7 and 8 the illustrated support structure is a carrier, specifically, the illustrated carrier is a printed circuit board 154. However, as discussed above, a container may be preferred as in the event of the first tubular body shattering the SSL elements 160 and other electrical components may not be exposed to a user, thus providing safety benefits.

As illustrated in FIGS. 7 and 8, the tube receiving member 156 may comprise an arcuate surface portion which engages with the second tubular body 130. This ensures that the carrier is fixed (secured) between the first tubular body 120 and the second tubular body 130. Further, the printed circuit board 154 of the carrier may be fixed between the first tubular body 120 and the second tubular body 130 without the SSL elements touching the first tubular body 120.

In the illustration of FIGS. 7 and 8 the construction of the support structure is relatively simple, however, as would be understood by the skilled person a tube receiving member 156 may be used with embodiments described above. For example, a heat sink may be incorporated into the support structure of the embodiment illustrated in FIGS. 7 and 8. A further example, would be the inclusion of a tube receiving member in the embodiments described above with reference to FIG. 1 to 5 or 6.

Figure 9:
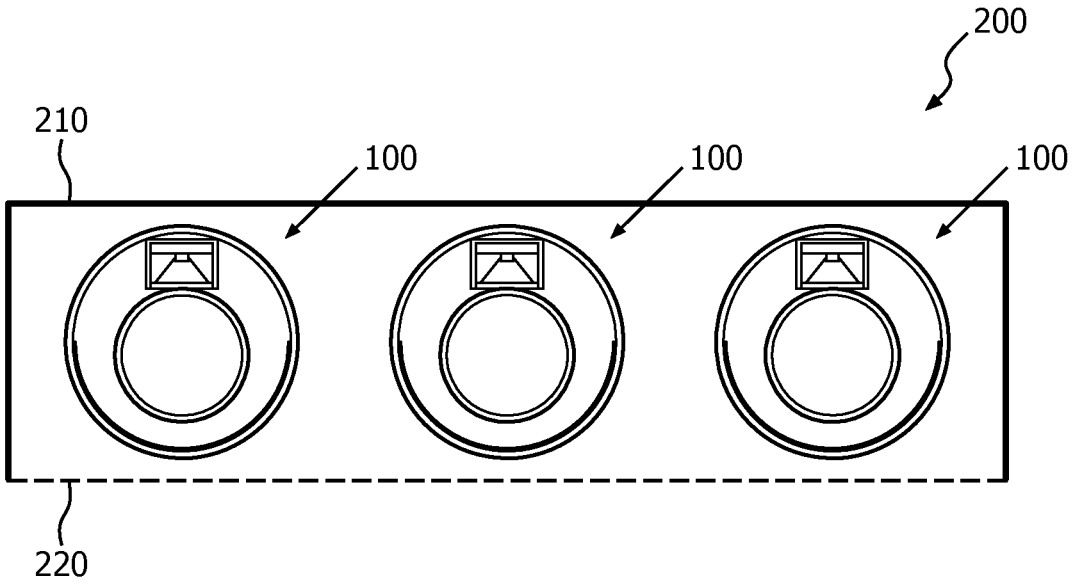
FIG. 9 depicts a schematic cross-section of a luminaire according to an example embodiment of the present invention.

The lighting device 100 according to any embodiment of the invention may be advantageously included in a luminaire 200 such as a holder of the lighting device 100, e.g. a ceiling light fitting, an armature for fitting underneath a cabinet or the like, an apparatus into which the lighting device is integrated, e.g. a cooker hood or the like, and so on. FIG. 9 schematically depicts a luminaire 200 comprising a plurality of lighting devices 100 fitted in a housing 210 of the luminaire 200. The luminaire 200 comprises a light exit window 220. The light exit window 220 may comprise beam shapers such as one or more lens arrays, reflectors and so on. Alternatively, the light exit window 220 may simply be formed by an opening in the housing 210. The internal surfaces of the housing 210 may be reflective to reflect light that exits the lighting devices 100.

As illustrated in FIG. 9, the solid state lighting elements 160 of the lighting devices 100 face the light exit window 220 of the luminaire 200. Such an arrangement may be particularly suitable where the region 122 is diffusive and not reflective. Alternatively, the lighting devices may be mounted in the luminaire 200 such that the solid state lighting elements 160 face away from the light exit window 220. Such an arrangement may be particularly suitable where the region 122 is (diffusive) reflective.

The luminaire 200 including the lighting devices 100 may be capable of producing an appearance that is visually similar to the appearance produced by a luminaire comprising traditional fluorescent or phosphorescent light tubes.

In a non-limiting example, the luminaires 200 may be ceiling armatures, e.g. armatures that are integrated in a suspended ceiling. Other examples of such luminaires 200 will be apparent to the skilled person.

As illustrated in FIGS. 3, 4 and 5, in particular, lighting devices 100 according to embodiments of the invention may be assembled by a method comprising inserting the second tubular body 130 into the first tubular body 120, inserting the support structure into the first tubular body 120; and fixing the support structure within the first tubular body 120 using the first tubular body 120 and the second tubular body 130.

When the first tubular body 120 is provided with a diffusive and/or reflective region 122 facing the SSL elements 160 which is provided by a film 124, the method may further comprise inserting the film 124 into the first tubular body 120 with the second tubular 130 body and affixing the film 124 to the first tubular body 120.

For instance, the film 124 may be inserted into the first tubular body 120 with the second tubular body 130 by using a clip to clamp the film to the second tubular body 130. Once the film 124 has been inserted into the first tubular body 120 the clip may be removed. This is a particularly simple way of inserting the film 124 into the first tubular body 120 and, consequently, may not require awkward assembly processes and, therefore, may be relatively easily automated. Accordingly, such a assembly process may be cost-effective.

As discussed above, the film 124 may be held in place against the first tubular body 120 by its by its natural tendency to uncurl. This is a particularly simple way of holding the film 124 in place and accordingly does not require the use of complex components or difficult manufacturing procedures.

The method may comprise assembling the support structure, for example the support structure as illustrated in FIG. 1. For example, the support structure illustrated in FIG. 1 may be assembled by inserting a printed circuit board 134 having solid state lighting elements 160 mounted thereon into the container 146 and inserting the components 144 into the container 146.

When the lighting device 100 comprises a cap 110 as described above, the method may further comprise engaging the first tubular body 120 with the first engagement feature 112 of the cap 110, engaging the second tubular body 130 with the second engagement feature 114 of the cap 110 and engaging the support structure with the third engagement feature 116 of the cap 110. In this way, alignment of the components of the lighting device 100 may be achieved in a simple manner.

Further, as illustrated in FIG. 4 the cap 110 may include an alignment feature 118 for ensuring that the film 124 or coating providing the diffuse and/or reflective region is dimensioned (or positioned) to diffuse and/or reflect the light emitted by said SSL elements under emission angles within the first range. The alignment feature may be used for ensuring that the diffusive and/or reflective region 122 is aligned with the support structure and, consequently, with emission angles within said first range.

The method may further comprise application of an adhesive to bind surfaces of the first tubular body 120 with the first engagement feature 112 of the cap 110, surfaces of the second tubular body 130 with the second engagement feature 114 of the cap 110 and/or surfaces of the support structure with the third engagement feature 116 of the cap 110. Alternatively, any other suitable method of fixing may be used as will be apparent to the skilled person, e.g. an interference fit.

As the steps of the method are relatively simple and do not require steps such as the use of tape the method may be automated. As mentioned above, steps involving tape are often complicated and/or awkward and therefore difficult to automate and such steps were required, in particular, with prior art glass tubular body based lighting devices.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a first tubular body;

a second tubular body within the first tubular body; and a support structure within the first tubular body supporting a plurality of SSL elements on a support surface, said SSL elements being arranged to emit light under a range of angles including a first range, wherein the support structure is fixed within the first tubular body by the first tubular body and the second tubular body;

wherein the support structure comprises a carrier selected from at least one of a printed circuit board and a heat sink, wherein the SSL elements are mounted on said carrier;

wherein the carrier comprises at least one tube receiving member extending from the support surface, said at least one tube receiving member engaging with the second tubular body;

wherein the support structure comprises a container including said support surface, said container further comprising a light exit window opposite the support surface and separated from said support surface by a plurality of side surfaces, said light exit window being dimensioned to allow light emitted by the SSL elements under said first range of emission angles to directly exit the container; and wherein the support structure comprises a diffusive and/or reflective structure extending from the support surface to the light exit window for preventing light emitted by the SSL elements under emission angles outside said first range from directly exiting the container.

2. The lighting device of claim 1, wherein the first tubular body is provided with a diffusive and/or reflective region facing the luminous surfaces of the SSL elements, said diffusive and/or reflective region being dimensioned to diffuse and/or reflect the light emitted by said SSL elements under emission angles within said first range.

3. The lighting device of claim 2, wherein the diffusive and/or reflective region is provided by a film or a coating.

4. The lighting device of claim 1, wherein at least one of the first tubular body and the second tubular body comprises glass.

5. The lighting device of claim 1, wherein the tube receiving member comprises an arcuate surface portion which engages with the second tubular body.

6. The lighting device of claim 1, wherein said side surfaces include said diffusive and/or reflective structure.

7. The lighting device of claim 1, wherein the diffusive and/or reflective structure comprises at least one sloped section for redirecting light emitted by the plurality of SSL elements under an angle outside said first range towards the light exit window.

8. The lighting device of claim 7, comprising at least two of said sloped sections, wherein each of the two sloped sections is provided by a discrete component.

9. The lighting device of claim 1, wherein the second tubular body is transparent or translucent.

10. The lighting device of claim 1, further comprising at least one cap comprising:

a first engagement feature in engagement with the first tubular body;

a second engagement feature in engagement with the second tubular body; and a third engagement feature in engagement with the support structure.

11. A luminaire comprising the lighting device of claim 1.

12. A method of assembling a lighting device comprising a first tubular body, a second tubular body within the first tubular body; and a support structure within the first tubular body supporting a plurality of SSL elements on a support surface, said SSL elements being arranged to emit light under a range of angles including a first range, wherein the support structure is fixed within the first tubular body by the first tubular body and the second tubular body; wherein the support structure comprises a carrier selected from at least one of a printed circuit board and a heat sink, wherein the SSL elements are mounted on said carrier; wherein the carrier comprises at least one tube receiving member extending from the support surface, said at least one tube receiving member engaging with the second tubular body, wherein the support structure comprises a container including said support surface, said container further comprising a light exit window opposite the support surface and separated from said support surface by a plurality of side surfaces, said light exit window being dimensioned to allow light emitted by the SSL elements under said first range of emission angles to directly exit the container, and wherein the support structure comprises a diffusive and/or reflective structure extending from the support surface to the light exit window for preventing light emitted by the SSL elements under emission angles outside said first range from directly exiting the container, the method comprising:

inserting the second tubular body into the first tubular body;

inserting the support structure into the first tubular body; and fixing the support structure within the first tubular body using the first tubular body and the second tubular body.

13. The method of assembling a lighting device of claim 12, wherein the first tubular body is provided with a diffusive and/or reflective region facing the SSL elements provided by a film, and the method further comprises: inserting the film into the first tubular body with the second tubular body and affixing the film to the first tubular body.

* * * * *